US010571845B2

(12) United States Patent
Park et al.

(10) Patent No.: US 10,571,845 B2
(45) Date of Patent: Feb. 25, 2020

(54) IMAGE FORMING APPARATUS CAPABLE OF DETECTING DEVELOPMENT NIP DISENGAGING ERROR AND METHOD OF DETECTING DEVELOPMENT NIP DISENGAGING ERROR

(71) Applicant: Hewlett-Packard Development Company, L.P., Spring, TX (US)

(72) Inventors: Sang Jin Park, Suwon-si (KR); Sung Min Park, Suwon-si (KR); Hyo Joong Kim, Suwon-si (KR); Jong Woo Lee, Suwon-si (KR); Mi Young Kim, Suwon-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/478,030

(22) PCT Filed: Jan. 18, 2018

(86) PCT No.: PCT/KR2018/000825
§ 371 (c)(1),
(2) Date: Jul. 15, 2019

(87) PCT Pub. No.: WO2018/135868
PCT Pub. Date: Jul. 26, 2018

(65) Prior Publication Data

US 2019/0369539 A1 Dec. 5, 2019

(30) Foreign Application Priority Data

Jan. 19, 2017 (KR) ..... 10-2017-0009342

(51) Int. Cl.
*G03G 15/00* (2006.01)
*G03G 15/08* (2006.01)

(52) U.S. Cl.
CPC ..... *G03G 15/5058* (2013.01)

(58) Field of Classification Search
CPC ..... G03G 15/5058; G03G 15/0813
See application file for complete search history.

(56) References Cited

U.S. PATENT DOCUMENTS 8,064,782 B2 11/2011 Nakazato et al.
2005/0249515 A1 11/2005 Furukawa et al.
2009/0214241 A1* 8/2009 Kawaguchi ..... G03G 15/1615 399/66

(Continued)

*Primary Examiner* — G. M. A Hyder
(74) *Attorney, Agent, or Firm* — Jefferson IP Law, LLP

(57) ABSTRACT

An image forming apparatus capable of detecting a development nip disengaging error and a method of detecting a development nip disengaging error are provided. According to an example method, a test pattern is formed on a photoconductor of an image forming apparatus, the test pattern transferred to an intermediate transfer belt is detected through a sensor from a time when an operation of an adjusting member moving a developing roller is controlled such that the developing roller moves from a disengaging position where the developing roller is spaced from the photoconductor to disengage a development nip from the photoconductor to a developing position where the developing roller is in contact with the photoconductor to form the development nip, and whether the development nip disengaging error occurred is determined based on the detected test pattern.

20 Claims, 11 Drawing Sheets

(56) References Cited

U.S. PATENT DOCUMENTS

| | | | | |
|---|---|---|---|---|
| 2010/0124427 | A1* | 5/2010 | Sugiyama | G03G 15/0813 399/53 |
| 2010/0316400 | A1* | 12/2010 | Murasaki | G03G 15/0131 399/49 |
| 2010/0316413 | A1* | 12/2010 | Murasaki | G03G 15/0194 399/228 |
| 2012/0014717 | A1* | 1/2012 | Sugiyanna | G03G 15/0121 399/228 |
| 2012/0183332 | A1 | 7/2012 | Shin et al. | |
| 2013/0050723 | A1* | 2/2013 | Woo | H04N 1/506 358/1.9 |
| 2018/0074448 | A1* | 3/2018 | Endoh | G03G 15/0813 |

* cited by examiner

[Fig. 1]
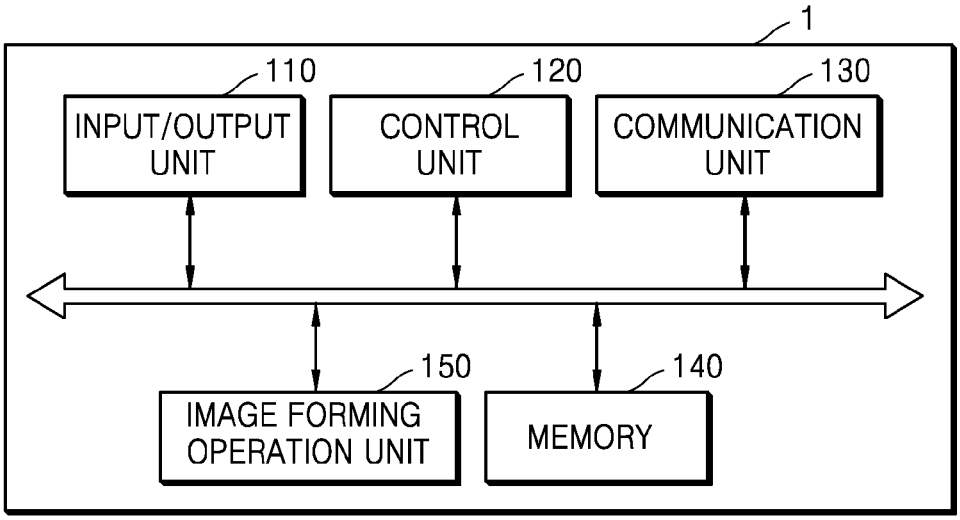

[Fig. 2]
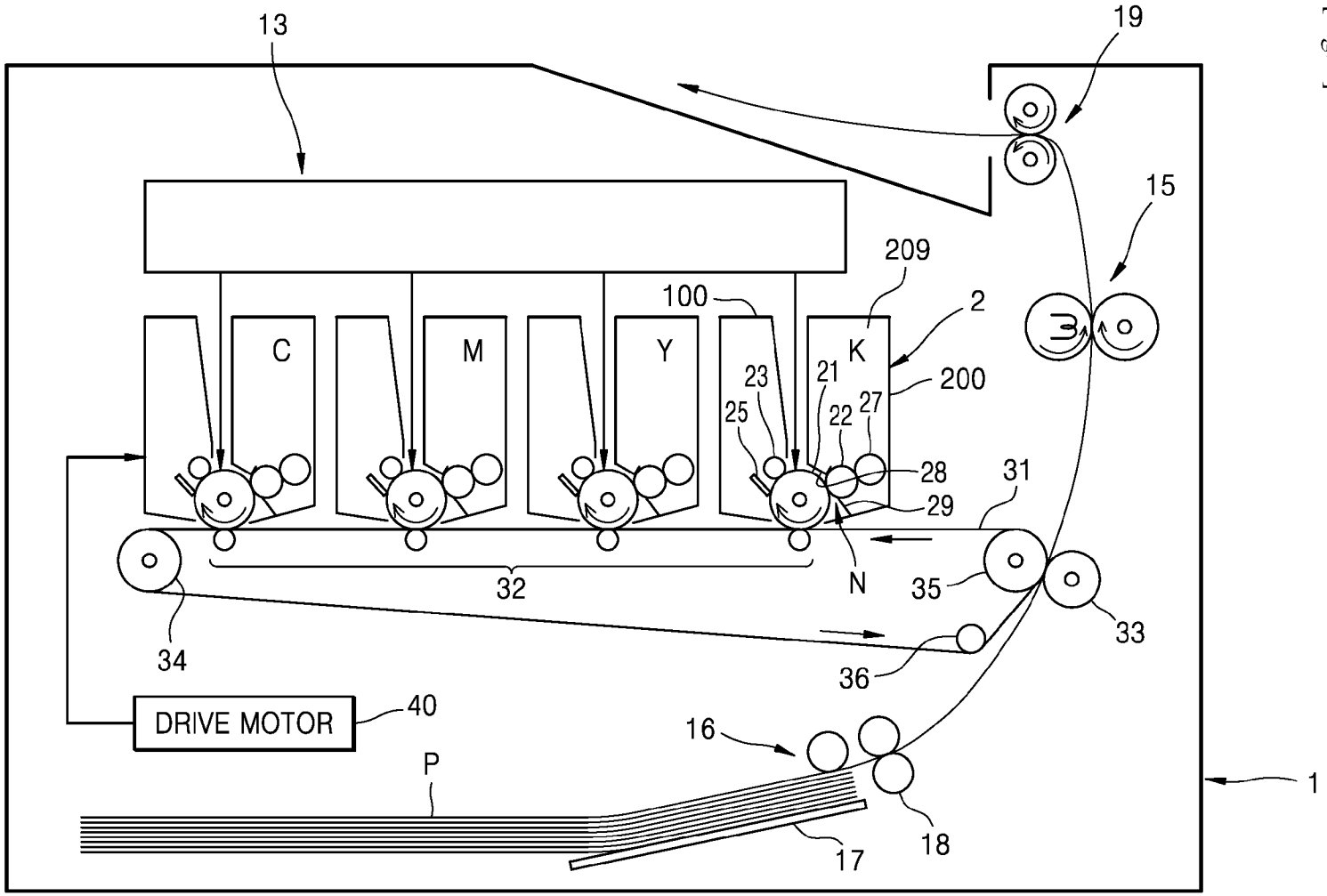

[Fig. 3A]
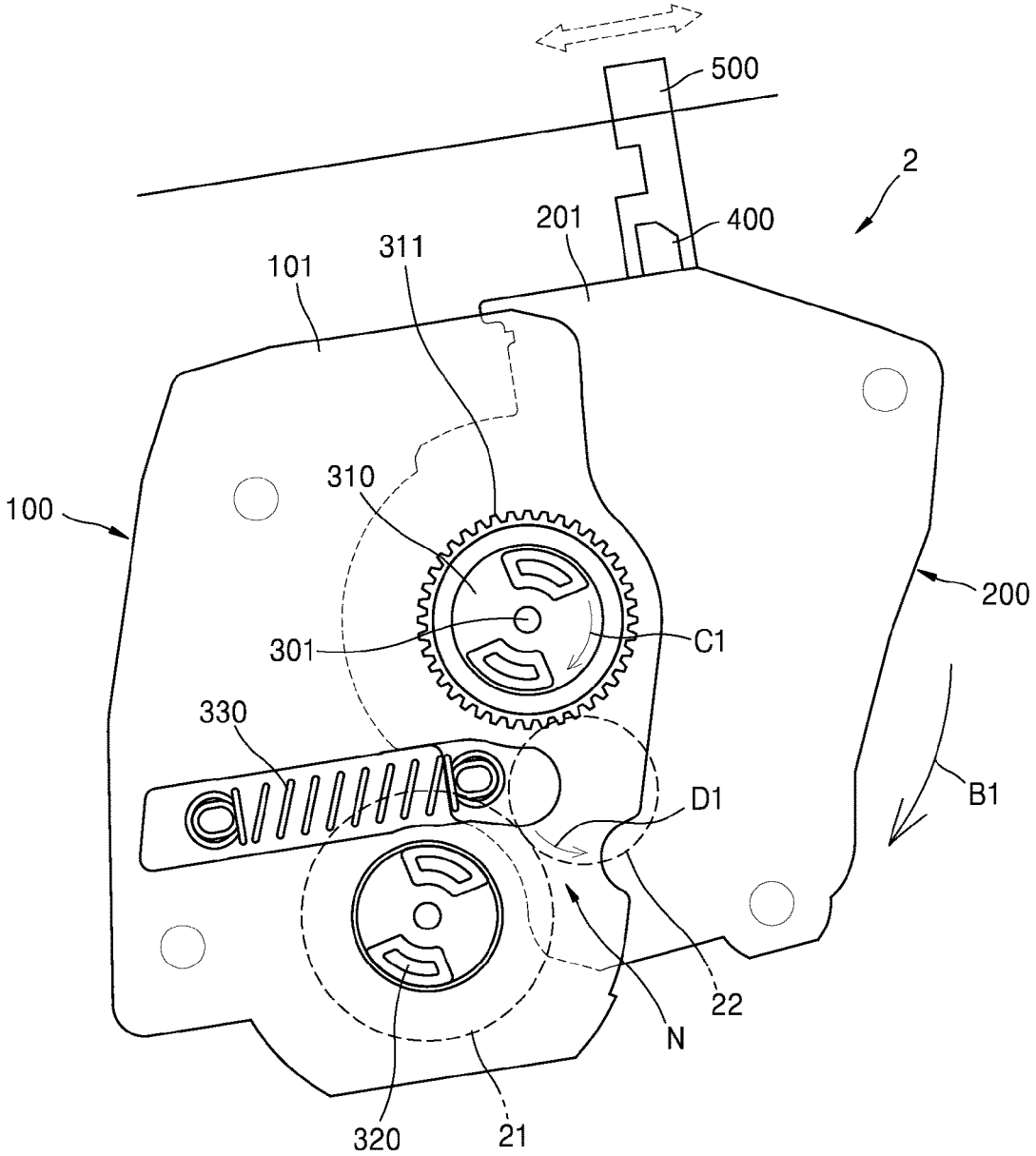

[Fig. 3B]
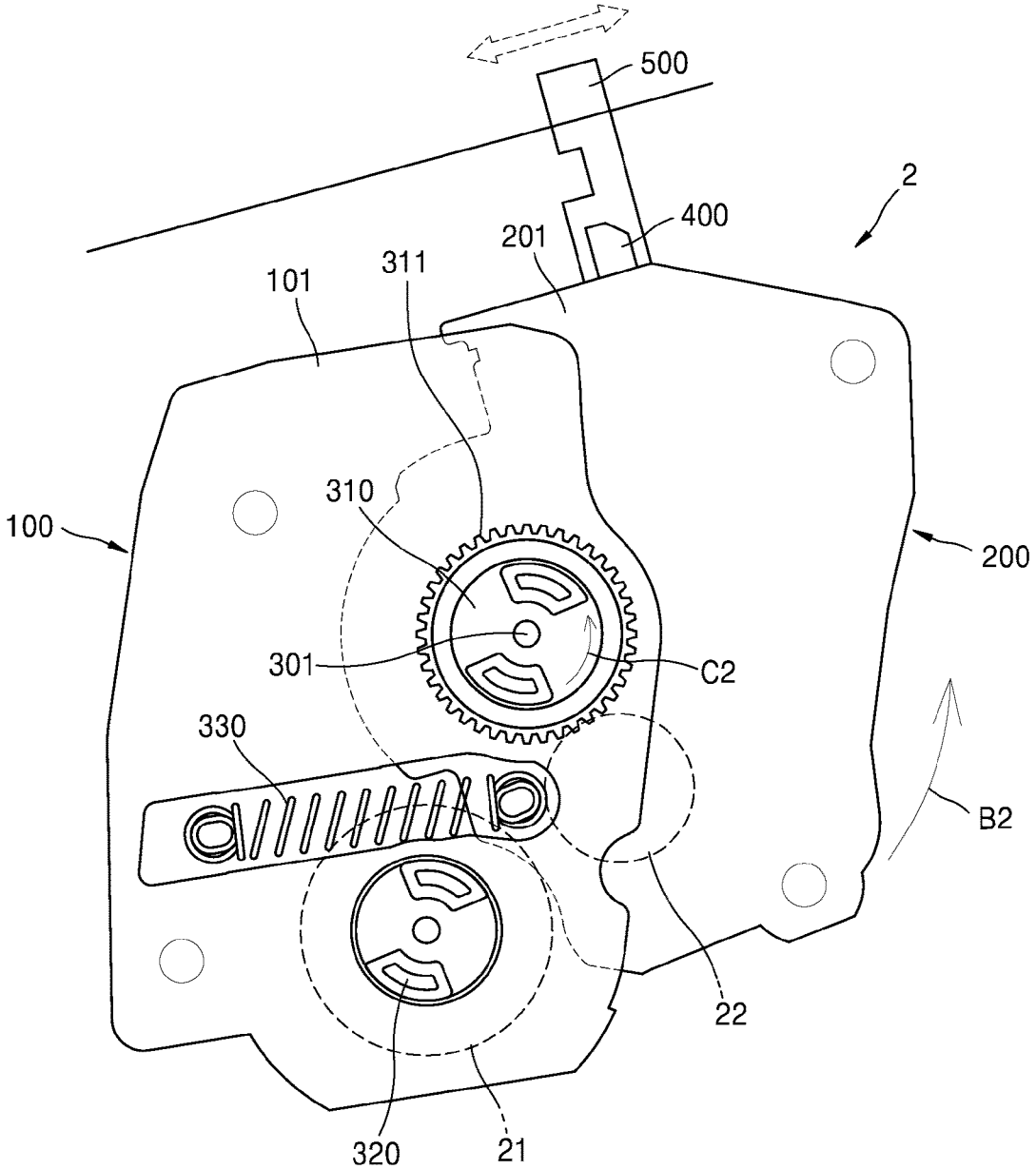

[Fig. 4A]
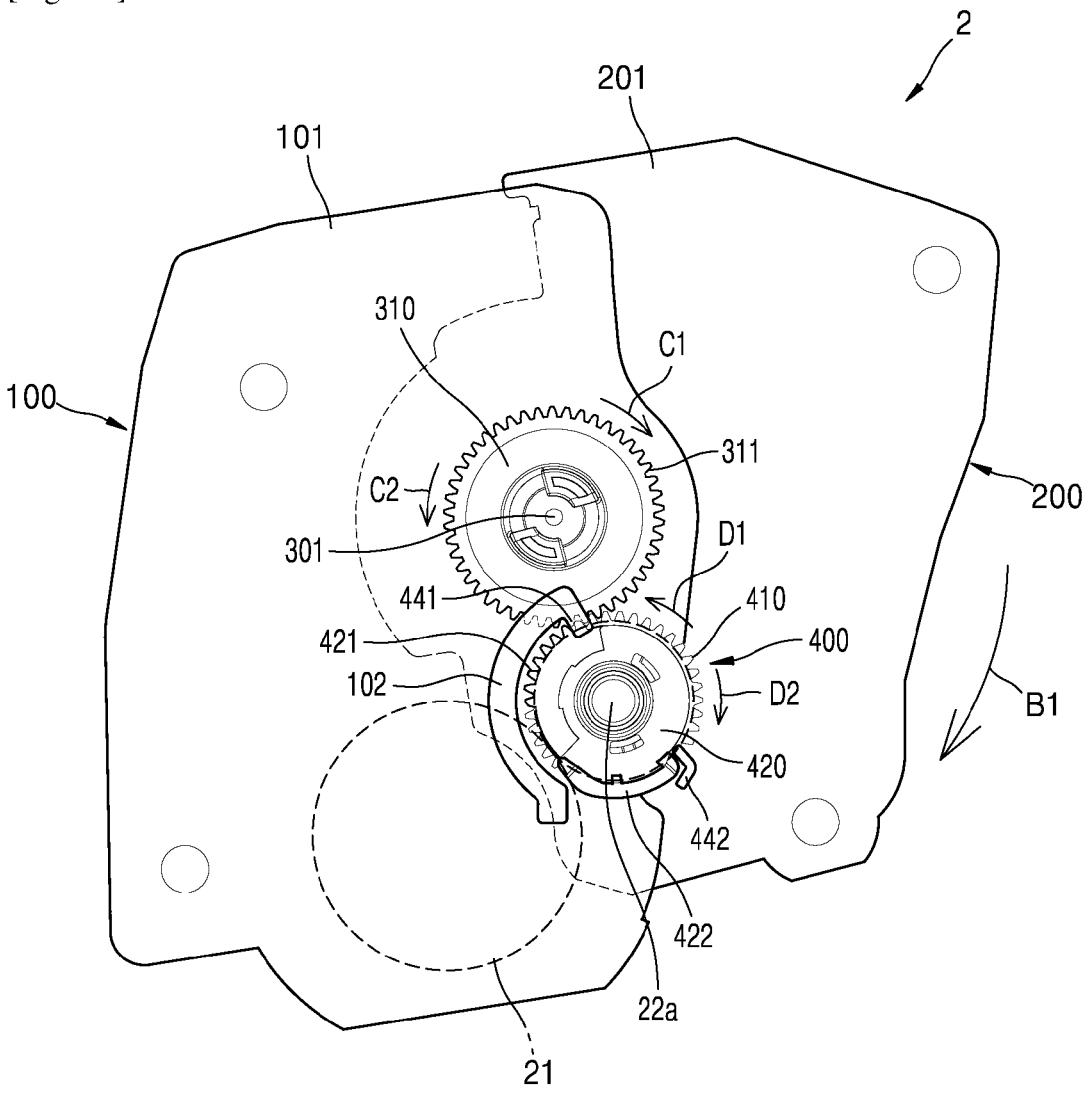

[Fig. 4B]
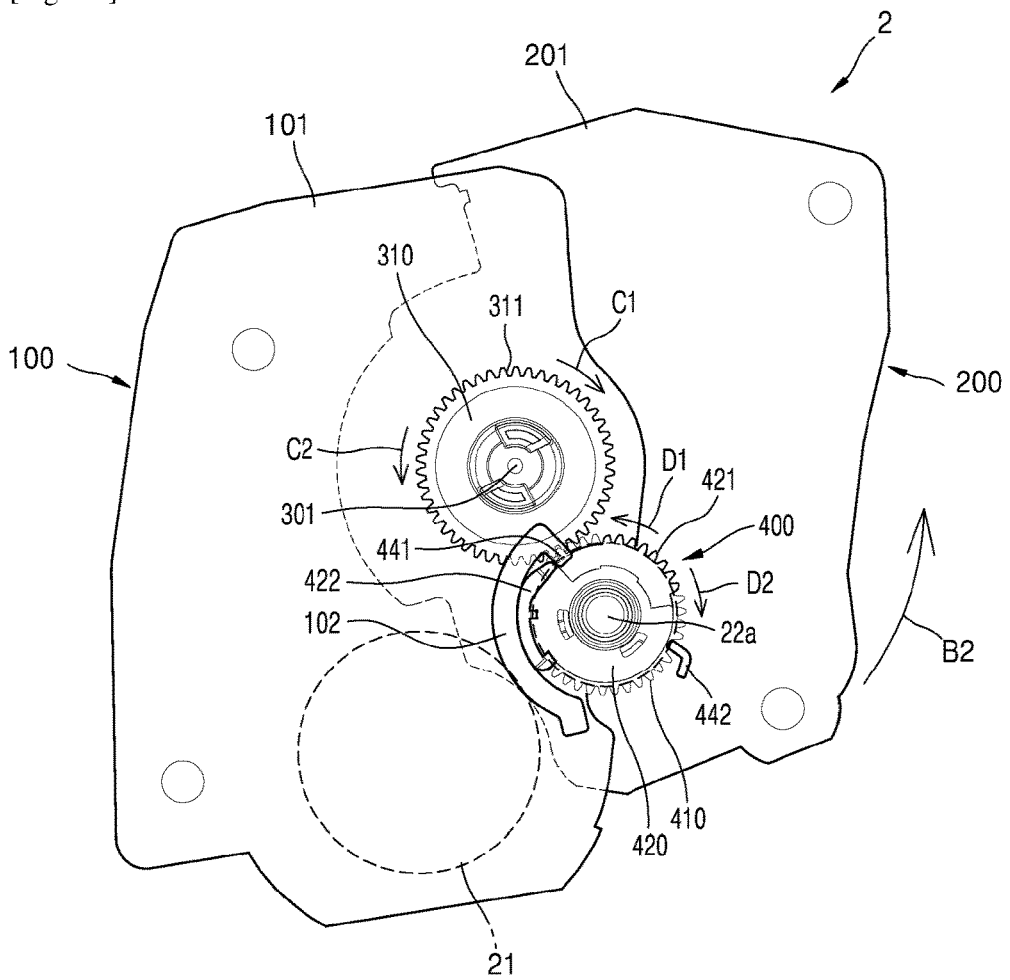
[Fig. 5]
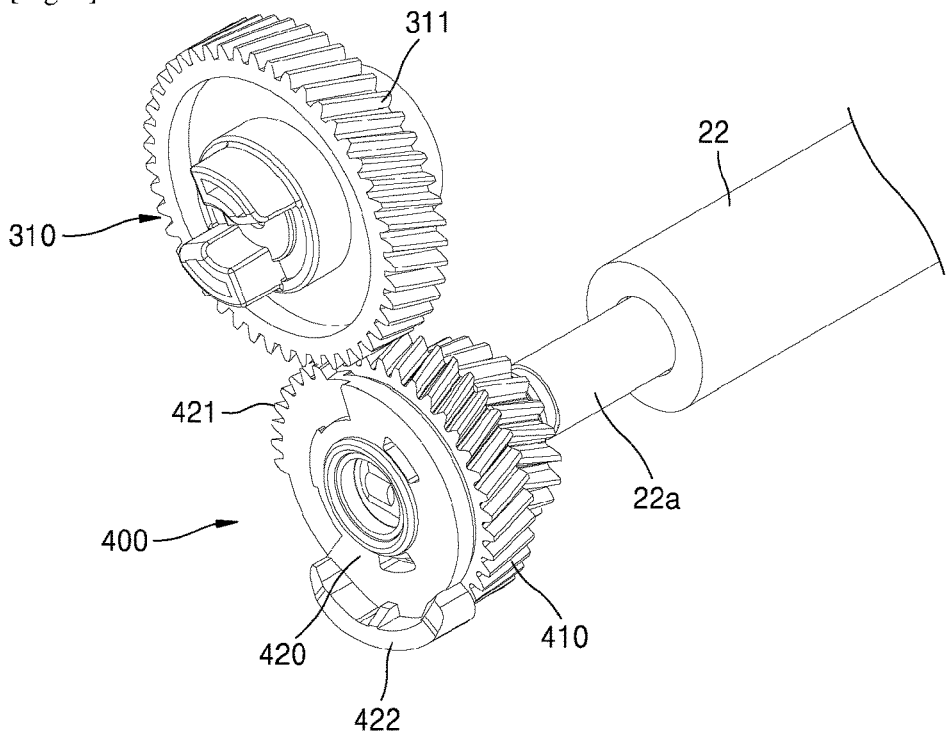

[Fig. 6]
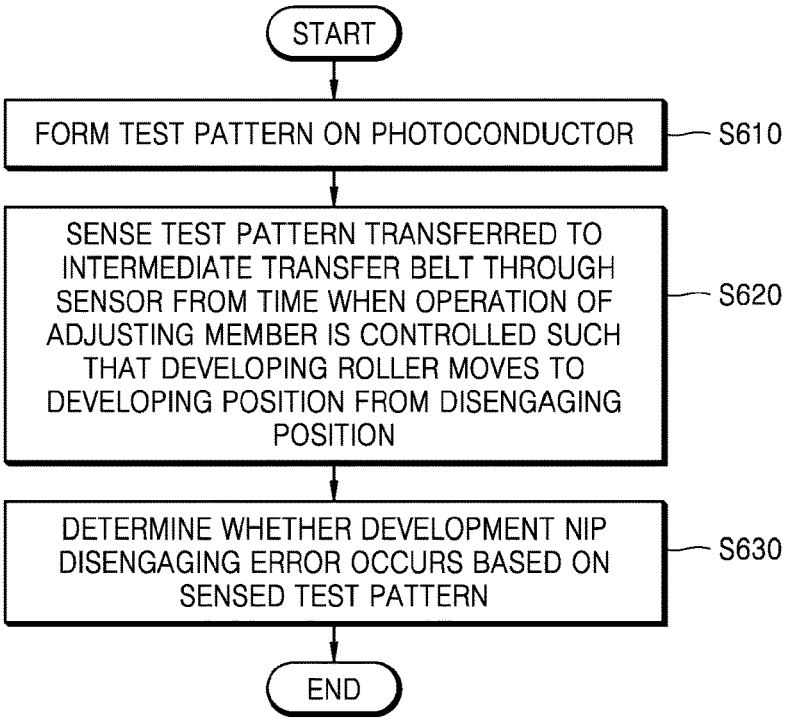
[Fig. 7]
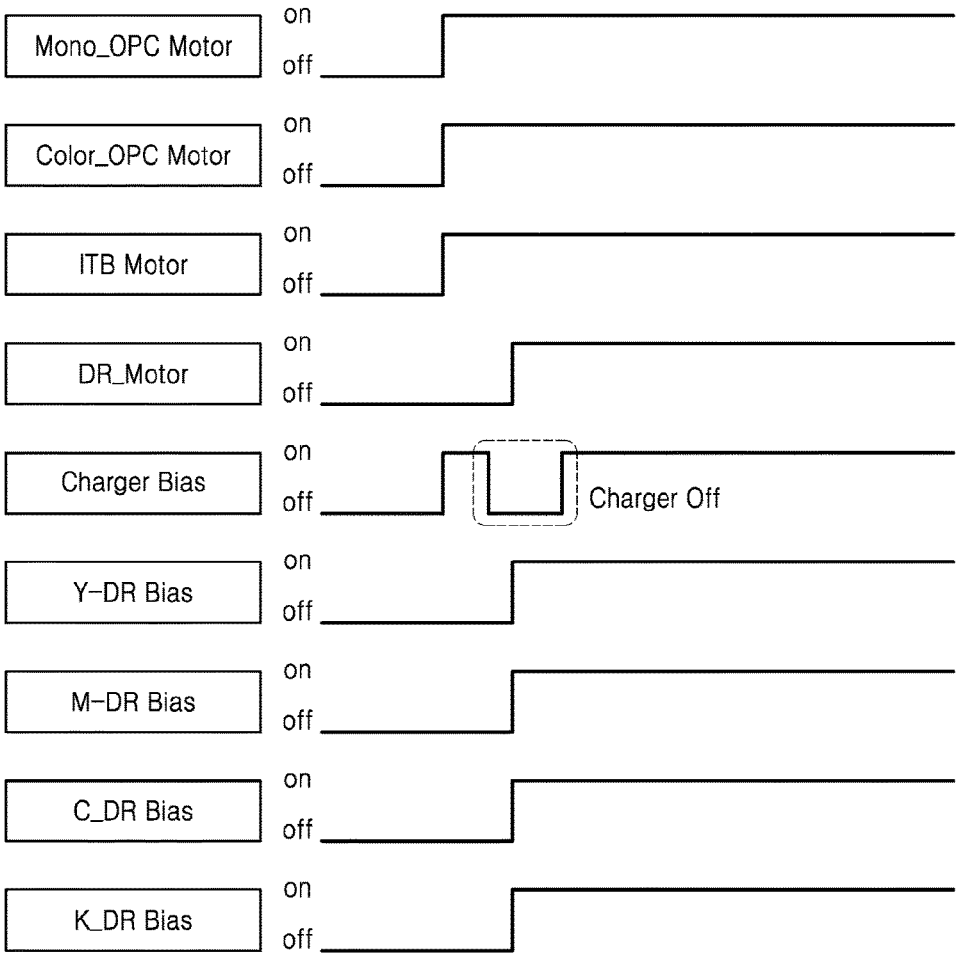

[Fig. 8]
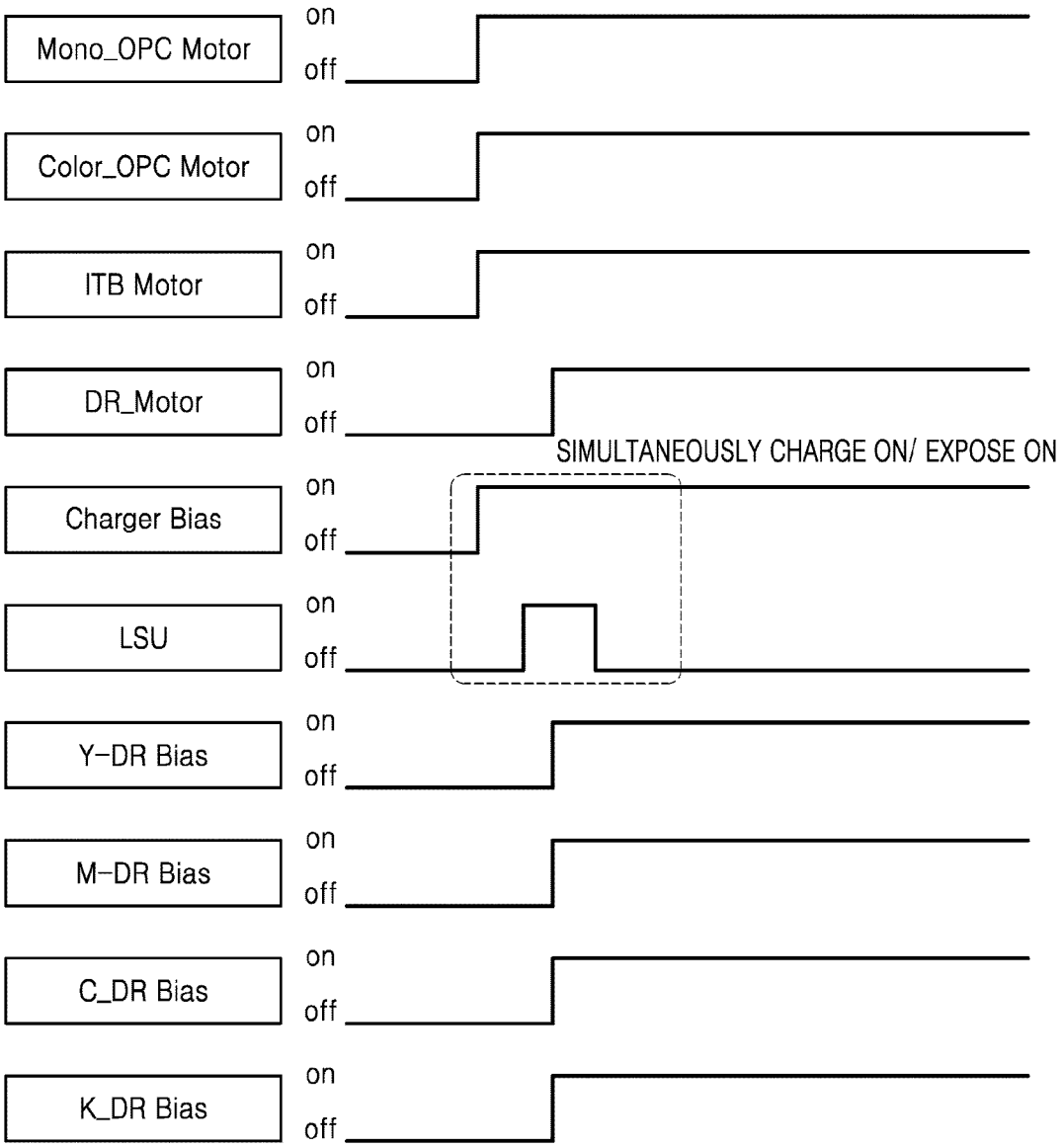

[Fig. 9]
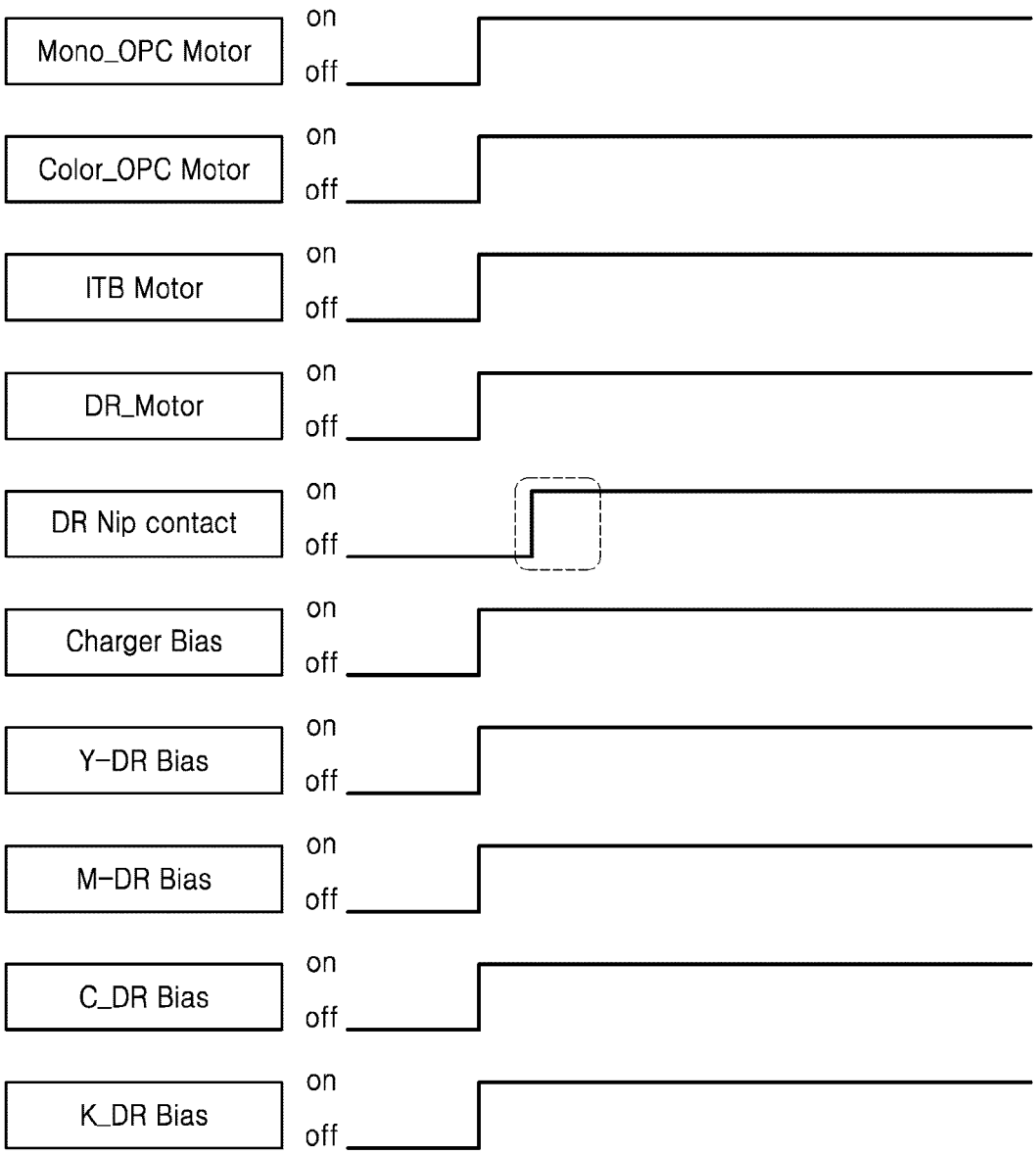
[Fig. 10]
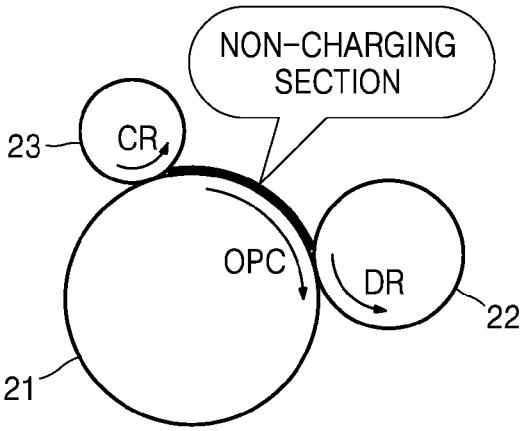

[Fig. 11]
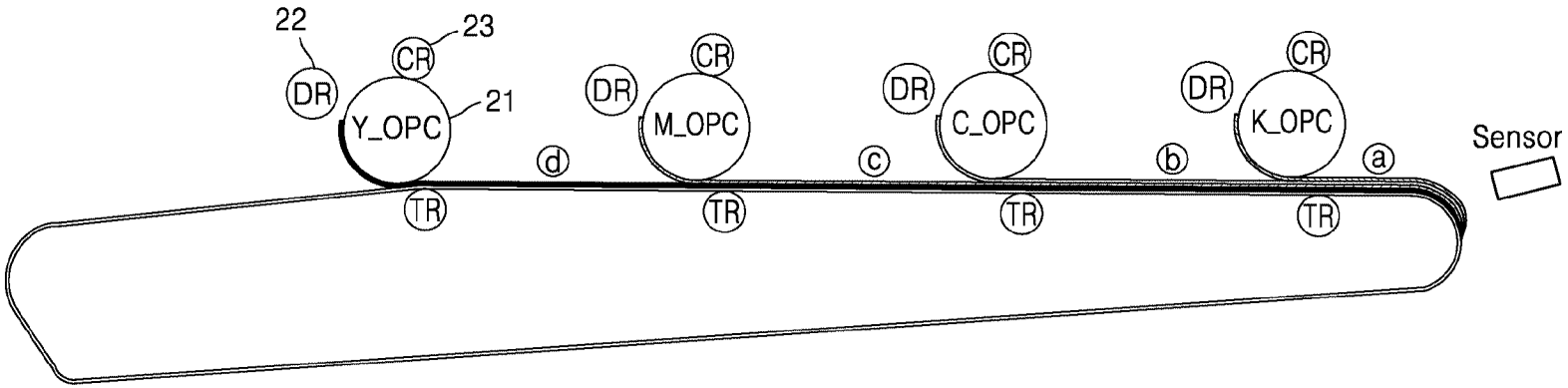

[Fig. 12]
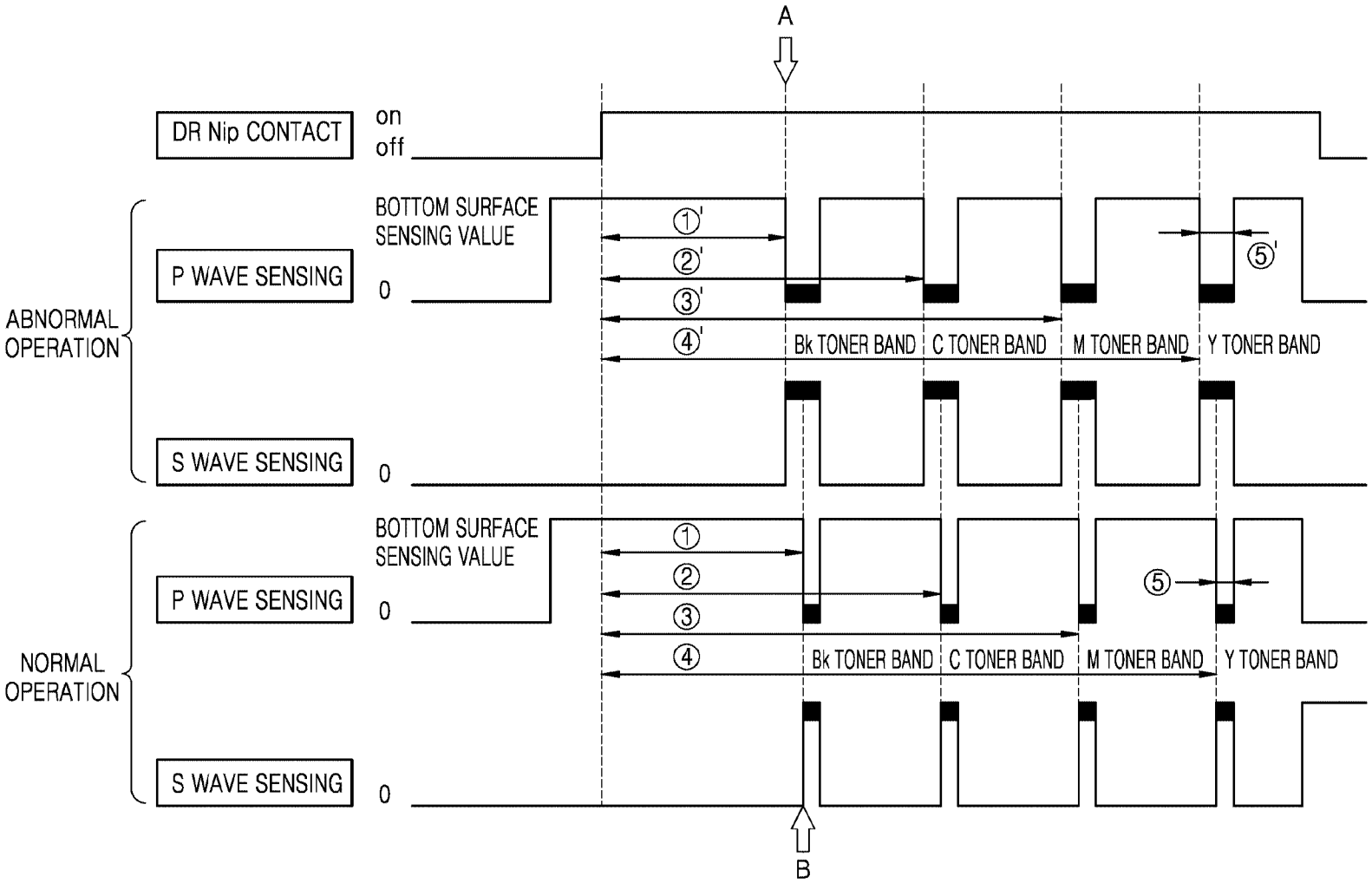

IMAGE FORMING APPARATUS CAPABLE OF DETECTING DEVELOPMENT NIP DISENGAGING ERROR AND METHOD OF DETECTING DEVELOPMENT NIP DISENGAGING ERROR

BACKGROUND ART

An image forming apparatus using an electrophotographic developing method forms an image on a recording medium such as paper through an image forming process including charging, exposing, developing, transferring, and fixing. For example, the image forming apparatus forms a toner image on a recording medium through charging, exposing, developing, and transferring while a photoconductor rotates when a charging roller, a developing roller, a transfer roller, etc. are at predetermined positions, temperatures, and pressures applied to the toner image, and fixes the toner image on the recording medium.

A developing unit may include a developing roller which receives a toner (a developer) and supplies the toner to an electrostatic latent image formed on a photoconductor. A developing cartridge is an assembly of parts for forming a visible toner image. The developing cartridge is detachable from a main body of the image forming apparatus and is a consumable item that can be replaced when the life span thereof has ended. In the case of a developing cartridge employing a contact developing method, a developing roller and the photoconductor come into contact with each other to form a development nip. When the photoconductor and the developing roller form a development nip for a long time, there is a risk of deformation of the developing roller and damage of the photoconductor.

DISCLOSURE OF INVENTION

Brief Description of Drawings

These and/or other aspects will become apparent and more readily appreciated from the following description of examples, taken in conjunction with the accompanying drawings in which:

FIG. 1 is a diagram showing a configuration of an image forming apparatus according to an example;

FIG. 2 is a diagram for explaining an operation of an image forming apparatus according to an example;

FIGS. 3A and 3B are side views of a developing cartridge in which FIG. 3A shows a state in which a development nip is formed by an adjustment member located outside the developing cartridge according to an example and FIG. 3B shows a state in which the development nip is disengaged according to an example;

FIGS. 4A and 4B are side views of a developing cartridge in which FIG. 4A shows a state in which a development nip is formed by an adjusting member inside the developing cartridge 2 according to an example and FIG. 4B shows a state in which the development nip is disengaged according to an example;

FIG. 5 is a perspective view of an adjusting member according to an example;

FIG. 6 is a flowchart for explaining a method of detecting a development nip disengaging error according to an example;

FIG. 7 is a diagram for explaining an example of forming a test pattern by using a charging voltage of a charging device;

FIG. 8 is a diagram for explaining an example of forming a test pattern by using a charging device and an exposure device;

FIG. 9 is a diagram for explaining an example of forming a test pattern using a non-charging section of a photoconductor;

FIG. 10 is a diagram for explaining a non-charging section of a photoconductor according to an example;

FIG. 11 is a diagram for explaining a process of detecting a test pattern transferred to an intermediate transfer belt through a sensor according to an example; and FIG. 12 is a diagram for explaining a method of determining whether a development nip disengaging error occurs based on a test pattern according to an example.

MODE FOR THE INVENTION

Reference will now be made to examples, which are illustrated in the accompanying drawings. In this regard, the examples may have different forms and should not be construed as being limited to the descriptions set forth herein. In order to further clearly describe features of the examples, descriptions of other features that are well known to one of ordinary skill in the art are omitted here.

In the specification, when an element is "connected" to another element, the elements may not only be "directly connected", but may also be "electrically connected" via another element therebetween. Also, when a region "may include" an element, the region may further include another element instead of excluding the other element, unless otherwise differently stated.

In the specification, an "image forming job" may denote any one of various jobs (for example, printing, copying, scanning, and faxing) related to an image, such as forming of an image or generating/storing/transmitting of an image file, and a "job" may denote not only an image forming job, but may also denote a series of processes required to perform the image forming job.

Also, an "image forming apparatus" may denote any apparatus capable of performing an image forming job, such as a printer, a scanner, a fax machine, a multi-function printer (MFP), or a display apparatus.

Also, a "hard copy job" may denote an operation of printing an image on a print medium, such as a paper, and a "soft copy job" may denote an operation of printing an image on a display device, such as a television (TV) or a monitor.

Also, "content" may denote any type of data that is a target of an image forming job, such as a picture, an image, or a document file.

Also, "print data" may denote data having a format printable by a printer.

Also, a "scan file" may denote a file generated by scanning an image by using a scanner.

Also, a "user" may denote a person who performs a manipulation related to an image forming job by using an image forming apparatus or a device connected to the image forming apparatus wirelessly or via wires. Also, a "manager" may denote a person who has authority to access all functions and a system of an image forming apparatus. A "manager" and a "user" may be the same person.

The present examples are directed to an image forming apparatus for detecting a development nip disengaging error and a method of detecting a development nip disengaging error, and descriptions of technical features widely known to one of ordinary skill in the art to which the following examples pertain are omitted.

FIG. 1 is a diagram showing a configuration of an image forming apparatus according to an example.

Referring to 1, the image forming apparatus may include a main body 1, an input/output unit 110, a control unit (i.e., processor) 120, a communication unit 130, a memory 140, and an image forming operation unit 150. Although not shown, the image forming apparatus may further include a power supply unit for supplying power to each element.

The input/output unit 110 may include an input unit for receiving an input or the like for performing an image forming operation from a user, and an output unit for displaying information on a result of the image forming operation, a status of the image forming apparatus, etc. For example, the input/output unit 110 may include an operation panel for receiving a user input and a display panel for displaying a screen.

For example, the input unit may include devices capable of receiving various types of user input, such as a keyboard, a physical button, a touch screen, a camera or a microphone. Further, the output unit may include, for example, a display panel or a speaker. However, the present disclosure is not limited thereto, and the input/output unit 110 may include a device supporting various inputs/outputs.

The control unit 120 controls the overall operation of the image forming apparatus, and may include at least one processor such as a CPU or the like. The control unit 120 may control other components included in the image forming apparatus to perform an operation corresponding to a user input received through the input/output unit 110. The control unit 120 may include at least one specialized processor corresponding to each function or may be a single integrated processor.

For example, the control unit 120 may execute a program stored in the memory 140, read data or a file stored in the memory 140, or store a new file in the memory 140.

The communication unit 130 may perform wired/wireless communication with another device or a network. To this end, the communication unit 130 may include a communication module supporting at least one of various wired/wireless communication methods. For example, the communication module may be a chipset, a sticker/barcode (e.g., a sticker containing an NFC tag), or the like that includes information necessary for communication.

Wireless communication may include at least one of, for example, wireless fidelity (Wi-Fi), Wi-Fi Direct, Bluetooth, ultra wide band (UWB), or near field communication (NFC). Wired communication may include, for example, at least one of Ethernet, USB, or high definition multimedia interface (HDMI).

The communication unit 130 may be connected to an external device located outside the image forming apparatus and may transmit and receive signals or data. The communication unit 130 may transmit signals or data received from an external device, such as a user terminal, to the control unit 120 or may transmit signals or data generated by the control unit 120 to the external device, such as the user terminal. For example, when the communication unit 130 receives a print command signal and print data from the user terminal, the control unit 120 may output the received print data through the image forming operation unit 150.

Various types of data including programs and files, such as applications, may be installed and stored in the memory 140. The control unit 120 may access the data stored in the memory 140 and use the data or store new data in the memory 140. Also, the control unit 120 may execute a program installed in the memory 140 and may install an application received from the outside through the communication unit 130 in the memory 140.

The image forming operation unit 150 may perform an image forming operation such as printing, scanning, or faxing. The image forming operation unit 150 may include only some of a printing unit, a scanning unit, and a facsimile unit, or may further include a configuration for performing other kinds of image forming operations.

The printing unit may form an image on a recording medium using various printing methods such as an electrophotographic method, an inkjet method, a thermal transfer method, and a direct thermal method.

[The scanning unit may irradiate a document with light, receive reflected light, and read an image recorded on the document. As an image sensor for reading the image from the document, for example, a charge coupled device (CCD), a contact type image sensor (CIS) or the like may be employed. The scanning unit may have a flatbed structure in which a document is positioned at a fixed position and an image sensor is moved to read an image, a document feed structure in which the image sensor is positioned at the fixed position and the document is fed, or a combined structure thereof.

In the case of the facsimile unit, a configuration for scanning an image may be shared with the scanning unit, a configuration for printing a received file may be shared with the printing unit, and a scanned file may be transmitted to a destination, or a file may be received from outside.

[The names of the above-described components of the image forming apparatus may vary. Further, the image forming apparatus according to examples of the present disclosure may be configured to include at least one of the above-described components, and some of the components may not be included or other additional components may be further included.

FIG. 2 is a diagram for explaining an operation of an image forming apparatus according to an example.

In the following example, the image forming apparatus prints a color image on a recording medium P by using an electrophotographic method. Referring to FIG. 2, the image forming apparatus may include the main body 1 and a plurality of developing cartridges 2. The plurality of developing cartridges 2 may be attached to or detached from the main body 1. The main body 1 includes an exposure device 13, a transfer device, and a fixing device 15. The main body 1 also includes a recording medium transfer unit for loading the recording medium P on which an image is to be formed and for transferring the recording medium P.

For color printing, the plurality of developing cartridges 2 may include four developing cartridges 2 for developing an image of, for example, cyan C, magenta M, yellow Y, and black B, respectively. The four developing cartridges 2 may each contain a developer of the cyan C, magenta M, yellow Y, and black B colors, for example, toner. Although not shown in the drawing, toners of the cyan C, magenta M, yellow Y, and black B colors may be accommodated in four toner supply containers, respectively, and may be supplied from four toner supply containers to the four developing cartridges 2, respectively. The image forming apparatus may further include the developing cartridge 2 for accommodating and developing toners of various colors such as light magenta and white in addition to the above-described colors. Hereinbelow, it is assumed that the image forming apparatus includes the four developing cartridges 2. Unless specifically stated otherwise, when C, M, Y and K are denoted by reference numerals, the reference numerals denote components for developing images of the cyan C, magenta M, yellow Y, and black B colors, respectively.

The developing cartridge 2 of the present example is an integral developing cartridge. The developing cartridge 2 may include a photosensitive unit 100 and a developing unit 200.

The photosensitive unit 100 may include a photosensitive drum 21. The photosensitive drum 21 is an example of a photoconductor on which an electrostatic latent image is formed and may include a conductive metal pipe and a photosensitive layer formed on the periphery thereof. The charging roller 23 is an example of a charging device that charges the photosensitive drum 21 to have a uniform surface potential. Instead of the charging roller 23, a charging brush, a corona charging device, or the like may be employed. The photosensitive unit 100 may further include a cleaning roller (not shown) for removing impurities on a surface of the charging roller 23. A cleaning blade 25 is an example of a cleaning means for removing toner and impurities remaining on the surface of the photosensitive drum 21 after a transferring process described later. Other types of cleaning devices, such as a brush that rotates instead of the cleaning blade 25, may be employed.

The developing unit 200 includes a toner accommodating unit 209. The developing unit 200 supplies the toner accommodated in the toner accommodating unit 209 to an electrostatic latent image formed on the photosensitive drum 21 to develop the electrostatic latent image into a visible toner image. As a developing method, a one-component developing method using toner and a two-component developing method using toner and carrier have been used. A developing roller 22 is for supplying the toner to the photosensitive drum 21. A developing bias voltage for supplying the toner to the photosensitive drum 21 may be applied to the developing roller 22.

In the present example, the developing roller 22 and the photosensitive drum 21 are in contact with each other and use a contact developing method to form a development nip N. A supplying roller 27 supplies the toner from the toner accommodating unit 209 to a surface of the developing roller 22. To this end, a supply bias voltage may be applied to the supply roller 27. The developing unit 200 may further include a regulating member 28 for regulating an amount of toner supplied to the development nip N where the photosensitive drum 21 and the developing roller 22 are in contact with each other. The regulating member 28 may be, for example, a blade that elastically contacts the surface of the developing roller 22. The developing unit 200 may further include a lower sealing member 29 for preventing leakage of the toner by contacting the developing roller 22 on the opposite side of the regulating member 28. The lower sealing member 29 may be, for example, a film which is in contact with the developing roller 22.

The exposure device 13 irradiates the photosensitive drum 21 with modulated light corresponding to image information to form an electrostatic latent image on the photosensitive drum 21. As the exposure device 13, a laser scanning unit (LSU) using a laser diode as a light source or an LED exposure device using a light emitting diode (LED) as a light source may be employed.

The transfer unit may include an intermediate transfer belt 31, a primary transfer roller 32, and a secondary transfer roller 33. The toner image developed on the photosensitive drum 21 of each of developing cartridges 2C, 2M, 2Y, and 2K is temporarily transferred to the intermediate transfer belt 31. The intermediate transfer belt 31 is supported by support rollers 34, 35 and 36 and circulated. Four primary transfer rollers 32 are disposed at positions facing the photosensitive drums 21 of the respective developing cartridges 2C, 2M, 2Y, and 2K with the intermediate transfer belt 31 therebetween. The four primary transfer rollers 32 receive a primary transfer bias voltage for primarily transferring the toner image developed on the photosensitive drum 21 to the intermediate transfer belt 31. Instead of the primary transfer roller 32, a corona transporter or a pin scorotron transporter may be employed. The secondary transfer roller 33 is positioned to face the intermediate transfer belt 31. A secondary transfer bias voltage for transferring the toner image primarily transferred to the intermediate transfer belt 31 to the recording medium P is applied to the secondary transfer roller 33.

When a print command is received by the image forming apparatus, a control unit (not shown) charges a surface of the photosensitive drum 21 to a uniform potential by using the charging roller 23. The exposure device 13 scans the photosensitive drum 21 of the developing cartridges 2C, 2M, 2Y, and 2K with four light beams modulated in accordance with the image information of each color and forms electrostatic latent images on the photosensitive drum 21. The developing rollers 22 of the developing cartridges 2C, 2M, 2Y, and 2K supply C, M, Y and K toners to the corresponding photosensitive drums 21, respectively, so as to convert the electrostatic latent images into visible toner images. The developed toner images are primarily transferred to the intermediate transfer belt 31. The recording medium P loaded on a loading table 17 is drawn out one by one by a pickup roller 16 and is fed by a feed roller 18 to a transfer nip formed by the secondary transfer roller 33 and the intermediate transfer belt 31. The toner images primarily transferred onto the intermediate transfer belt 31 by the secondary transfer bias voltage applied to the secondary transfer roller 33 are secondarily transferred to the recording medium P. When the recording medium P passes through the fixing device 15, the toner images are fixed to the recording medium P by heat and pressure. The recording medium P on which fixing is completed is discharged to the outside by the discharge roller 19.

The photosensitive drum 21 and the developing roller 22 are in contact with each other and form the development nip N. Hereinafter, formation and disengagement of the development nip N will be described.

FIGS. 3A and 3B are side views of a developing cartridge In which FIG. 3A shows a state in which a development nip N is formed by an adjusting member located outside the developing cartridge according to an example and FIG. 3B shows a state in which the development nip N is disengaged according to an example.

Referring to FIGS. 3A and 3B, the developing cartridge 2 may include the photosensitive unit 100 and the developing unit 200. The photosensitive unit 100 may include a first frame 101 and a photosensitive drum 21 supported by the first frame 101. The developing unit 200 may include a second frame 201 and a developing roller 22 supported by the second frame 201. The photosensitive unit 100 and the developing unit 200 may be rotatably connected at a developing position (FIG. 3A) where the photosensitive drum 21 and the developing roller 22 are in contact with each other to form the development nip N and a disengaging position (FIG. 3B) where the photosensitive drum 21 and the developing roller 22 are spaced from each other and the development nip N is disengaged. For example, the photosensitive unit 100 and the developing unit 200 are rotatably connected to the developing position and the disengaging position via a hinge shaft 301. Because the photosensitive drum 21 operates according to a position of the primary transfer roller 32 or the like in the image forming apparatus, a position of the photosensitive drum 21 is fixed when the developing cartridge 2 is mounted on the main assembly 1. The developing unit 200 is rotatably coupled to the photosensitive unit 100 via the hinge shaft 301.

Rotation members of the developing cartridge 2, for example, the photosensitive drum 21, the development roller 22, the supply roller 27, and the like may be connected to a drive motor 40 disposed in the main body 1 (shown in FIG. 1) and driven when the developing cartridge 20 is mounted on the main body 1. The drive motor 40 may drive all of the four developing cartridges 2 and one drive motor 40 may be arranged for each of the four developing cartridges 2.

For example, the developing cartridge 2 may include a coupler 310 connected to the drive motor 40 included in the main assembly 1 when the developing cartridge 2 is mounted on the main assembly 1. Rotating members may be connected to the coupler 310 by power coupling means, e.g., gears, not shown. The developing cartridge 2 may further include a coupler 320 connected to the drive motor 40 included in the main assembly 1 when the developing cartridge 2 is mounted on the main assembly 1. In this case, the rotating members of the developing unit 200, for example, the developing roller 22, the supplying roller 27 and the like, may be connected to the coupler 310 and driven, and the rotating members in the photosensitive unit 100, for example, the photosensitive drum 21 may be connected to the coupler 320 and driven. The coupler 320 may be positioned, for example, coaxially with a rotation shaft of the photosensitive drum 21, or may be installed on the rotation shaft of the photosensitive drum 21. The hinge shaft 301 may be coaxial with the rotational axis of the coupler 310, for example.

An elastic member 330 provides an elastic force in a direction in which the development nip N is formed. The elastic member 330 provides an elastic force to rotate the developing unit 200 in the direction in which the development nip N is formed. The developing unit 200 rotates via the hinge shaft 301 due to the elastic force of the elastic member 330 so that the developing roller 22 contacts the photosensitive drum 21, and thus, the development nip N may be formed as shown in FIG. 3A. FIGS. 3A and 3B show a tension coil spring having one end and another end supported by the photosensitive unit 200 and the developing unit 100, respectively, as an example of the elastic member 330. However, the elastic member 330 is not limited thereto. For example, as the elastic member 330, various types of members such as a torsion coil spring and a leaf spring may be employed.

Referring to FIGS. 3A and 3B, an adjusting member 400 for adjusting the development nip N is located outside the developing cartridge 2. A pressing member 500, provided in the main body 1 and capable of moving, is combined with the adjusting member 400 protruding from the outside of the developing cartridge 2. Thus, when the pressing member 500 is pressed against the adjusting member 400, the developing unit 200 rotates via the hinge shaft 301 along a movement direction of the pressing member 500 and the development nip N is disengaged. Conversely, when the pressing member 500 is not pressed and thus is disengaged from the adjusting member 400, the development nip N is formed by the elastic member 330.

According to another example, the developing cartridge 2 may have the adjusting member 400, provided in the image forming apparatus, for switching the developing unit 200 to the developing position for forming the development nip N and the disengaging position for disengaging the development nip N. This will be described with reference to FIGS. 4A, 4B and 5.

FIGS. 4A and 4B are side views of a developing cartridge in which FIG. 4A shows a state in which a development nip is formed by an adjusting member inside the developing cartridge according to an example and FIG. 4B shows a state in which the development nip is disengaged according to an example. FIG. 5 is a perspective view of an adjusting member according to an example.

Referring to FIGS. 4A, 4B and 5, when the developing unit 200 is positioned at a developing position, the developing roller 22 contacts the photosensitive drum 21 to form the development nip N. When the developing unit 200 is positioned at a disengaging position, the developing roller 22 is separated from the photosensitive drum 21 and the development nip N is disengaged. The adjusting member 400 is switched to a first state in which the developing unit 200 rotates in the disengaging position during non-printing (during no image forming operation and during a non-image forming period) and to a second state in which the developing unit 200 is allowed to rotate to the developing position during printing (during the image forming operation and during an image forming period). The adjusting member 400 rotates the developing unit 200 to the developing position and the disengaging position in accordance with a rotation direction. The adjusting member 400 is connected to the coupler 310 and rotated. The adjusting member 400 may switch the developing unit 200 to the developing position and the disengaging position in accordance with a rotation direction of the coupler 310. For example, when the coupler 310 rotates in a C1 direction, the developing roller 22 rotates in a forward direction D1. The C1 direction is a rotation direction during image formation. The adjusting member 400 is maintained in the second state. When the coupler 310 rotates in a C2 direction, adjusting member 400 is switched to the first state, and the developing unit 200 rotates in a B2 direction via the hinge shaft 301 to be switch to the disengaging position. When the coupler 310 rotates in the C1 direction again, the adjusting member 400 is switched to the second state and the developing unit 200 rotates in a B1 direction via the hinge axis 301 due to the elastic force of the elastic member 330 so that the developing unit 200 is switched to the developing position.

The adjusting member 400 of the present example is installed coaxially with a rotation axis of the developing roller 22. At least one member constituting the adjusting member 400 is installed on the rotation axis of the developing roller 22. Therefore, since a structure for forming/disengaging the development nip N is implemented in the developing cartridge 2, the structure of the main body 1 of the image forming apparatus may be simplified. Further, the developing cartridge 2 capable of forming/disengaging the development nip N may be implemented in a compact size.

Referring to FIGS. 4A, 4B and 5, the adjusting member 400 may include a drive gear 410, a cam member 420, and a clutch member (not shown). The drive gear 410 is rotatably supported by the rotation shaft 22*a* of the developing roller 22. The drive gear 410 may be connected to a gear unit 311 of the coupler 310, for example, directly or via an idle gear (not shown). The cam member 420 is installed coaxially with the drive gear 410. For example, the cam member 420 may be rotatably installed on the rotation shaft 22*a* of the developing roller 22, and the cam member 420 may be rotatably supported on the support shaft 411 extending from the drive gear 410.

When the drive gear 410 rotates in at least one of a first direction and a second direction, the clutch member connects the cam member 420 to the drive gear 410 such that the drive gear 410 and a partial gear unit 421 are engaged with each other. The clutch member intermittently engages the drive gear 410 and the partial gear unit 421. In an example, the clutch member may include a friction member. The friction member is interposed between the drive gear 410 and the cam member 420 to provide a frictional force such that the cam member 420 may rotate together when the drive gear 410 rotates.

The cam member 420 may include the partial gear unit 421 and a cam unit 422. The partial gear unit 421 is intermittently (selectively) engaged with the gear unit 311. The partial gear unit 421 is engaged with the gear unit 311 or spaced from the gear unit 311 in accordance with a rotational phase of the cam member 420. The cam unit 422 contacts or is spaced from an interference unit 102 provided in the photosensitive unit 100 (for example, the first frame 101) in accordance with the rotational phase of the cam member 420. The cam member 420 rotates at a first position where the cam unit 422 contacts the interference unit 102 in accordance with the rotation direction of the drive gear 410 to rotate the developing unit 200 to the disengaging position, and rotates at a second position where the cam unit 422 is spaced from the interference unit 102 and the developing unit 200 is allowed to be rotated from the disengaging position to the developing position by the elastic force of the elastic member 330.

The developing cartridge 2 may further include a first stopper 441 that prevents the cam member 420 from rotating beyond the first position. When the cam member 420 reaches the first position, the cam unit 422 contacts the first stopper 441. The developing cartridge 2 may further include a second stopper 442 that prevents the cam member 420 from rotating beyond the second position. When the cam member 420 reaches the second position, the cam unit 422 contacts the second stopper 442.

Referring to FIG. 4A, the adjusting member 400 is in the second state. The cam member 420 is positioned in the second position. The cam unit 422 is spaced from the interference unit 102 and the partial gear unit 421 is spaced from the gear unit 311. The cam unit 422 is in contact with the second stopper 442. The developing unit 200 is maintained at the developing position by the elastic force of the elastic member 330 described above.

In the state shown in FIG. 4A, when the drive motor 40 provided in the main body 1 rotates in the forward direction for printing, the coupler 310 rotates in the C1 direction and the drive gear 410 rotates in the direction D1 (first direction). Although a frictional force generated by the frictional member is applied to the cam member 420, because the cam unit 422 is in contact with the second stopper 442, slip occurs between the cam member 420 and the friction member or between the friction member and the drive gear 410 and the cam member 420 does not rotate. The partial gear unit 421 is maintained to be spaced apart from the gear unit 311, and the adjusting member 400 is maintained in the second state. The cam member 420 is maintained in the second position. The developing roller 22 rotates in the D1 direction. Therefore, a printing operation may be performed in a state in which the development nip N is formed.

When the drive motor 40 rotates in a reverse direction in the state shown in FIG. 4A at the time of non-printing, the coupler 310 rotates in the C2 direction and the drive gear 410 rotates in the D2 direction (second direction). The cam member 420 rotates in the D2 direction together with the drive gear 410 by the frictional force generated by the friction member. Since the drive gear 410 rotates in the D2 direction, the cam unit 422 is separated from the second stopper 442 and the partial gear unit 421 is engaged with the gear unit 311 so that the adjusting member 400 is switched to the first state. When the drive motor 40 is continuously rotated in the reverse direction, the rotational force of the gear portion 311 is transmitted to the partial gear unit 421 so that the cam member 420 rotates in the D2 direction, and the cam portion 422 contacts the interference unit 102. A position of the photosensitive unit 100 is fixed so that the developing unit 200 rotates in relation to the hinge axis 301 in the B2 direction to reach the disengaging position as shown in FIG. 4B, the developing roller 22 is spaced from the photosensitive drum 21 and the development nip N is disengaged.

Even after the engagement of the partial gear unit 421 and the gear unit 311 is completed, the cam member 420 rotates in the direction D2 together with the drive gear 410 due to the frictional force generated by the friction member. When the cam unit 422 contacts the first stopper 441, the cam member 420 reaches the first position. The slip occurs between the cam member 420 and the friction member or between the friction member and the drive gear 410 and the cam member 420 does not rotate. The partial gear unit 421 is maintained to be spaced apart from the gear unit 311, and the adjusting member 400 is maintained in the first state. When the drive motor 40 is stopped, the developing unit 200 is to be restored to the developing position by the elastic force of the elastic member 330. However, since the cam unit 422 is in contact with the interference unit 102, the developing unit 200 may be maintained in the disengaging position.

For printing in the state shown in FIG. 4B, when the drive motor 40 rotates in the forward direction again, the drive gear 410 rotates in the D1 direction and the cam member 420 rotates together with the drive gear 410 in the D1 direction. The cam unit 422 is spaced from the first stopper 421 and the partial gear unit 421 is engaged with the gear unit 311 again. The adjusting member 400 is switched to the second state. When the drive motor 40 continuously rotates in the forward direction, the rotational force of the gear portion 311 is transmitted to the partial gear unit 421 so that the cam member 420 rotates in the D1 direction and the cam unit 422 is spaced from the interference unit 102. The developing unit 200 rotates to the developing position via the hinge shaft 301 due to the elastic force of the elastic member. As shown in FIG. 4A, the developing roller 22 is in contact with the photosensitive drum 21 to form the development nip N.

Even after the engagement of the gear portion 311 and the partial gear unit 421 is completed, the cam member 420 rotates in the direction D1 together with the drive gear 410 by the frictional force generated by the friction member. As shown in FIG. 4A, when the cam portion 422 contacts the second stopper 442, the cam member 420 reaches the second position. The slip occurs between the cam member 420 and the friction member or between the friction member and the drive gear 410 and the cam member 420 does not rotate. The partial gear unit 421 is maintained to be spaced apart from the gear unit 311 and the adjusting member 400 is maintained in the second state even if the drive motor 40 continuously rotates in the forward direction. The developing roller 22 rotates in the D1 direction. Therefore, the printing operation may be performed in a state in which the development nip N is formed.

If the development nip N is maintained in a state where the photosensitive drum 21 and the developing roller 22 are in contact with each other while the image forming operation is not performed, there is a risk of deformation of the developing roller 22 and damage of the photosensitive member. If the development nip N is maintained in a state in which the photosensitive drum 21 and the developing roller 22 are in contact with each other during a non-image forming interval between image forming periods when a plurality of images are successively printed, because the toner on the photosensitive drum 21 is transferred to the photosensitive drum 21 from the developing roller 22, an amount of consumed toner may increase and toner waste may increase as the photosensitive drum 21 and the developing roller 22 rotate in contact with each other. Thus, stress may be applied to the developing roller 22, and thus, the life span may become shorter. Therefore, it is important to detect a case where the adjusting member 400 for adjusting the development nip N operates abnormally, the forming state and the disengaging state of the development nip N are not accurately distinguished, and disengaging of the development nip N is poor. Hereinafter, an example of an image forming apparatus and a method for detecting a development nip disengaging error will be described.

FIG. 6 is a flowchart of a method of detecting a development nip disengaging error according to an example.

An image forming apparatus employing a method of detecting a development nip disengaging error may include a photoconductor, a charging device for applying a charging voltage to charge the photoconductor, the exposure device 13 exposing the photoconductor to light to form thereon an electrostatic latent image, the developing roller 22 supplying a toner to the electrostatic latent image to develop the electrostatic latent image, the adjusting member 400 moving the developing roller 22 to a developing position in which the developing roller 22 is in contact with the photoconductor and forms a development nip and a disengaging position in which the developing roller 22 is spaced from the photoconductor and the development nip is disengaged, and the intermediate transfer belt 31 receiving a toner image formed on the photoconductor, and a sensor detecting the toner image transferred to the intermediate transfer belt 31. The control unit 120 of the image forming apparatus may perform the method of detecting the development nip disengaging error of the image forming apparatus as follows.

Referring to FIG. 6, the image forming apparatus may form a test pattern on the photoconductor in operation 5610.

According to an example, the image forming apparatus may form the test pattern by charging the photoconductor with a charging voltage applied from the charging device for a predetermined period and not applying the charging voltage for a predetermined period.

FIG. 7 is a diagram for explaining an example of forming a test pattern by using a charging voltage generated by a charging device.

Referring to FIG. 7, in a printing operation in a state in which a development nip is disengaged, a photoconductor and the intermediate transfer belt 31 are driven while the charging voltage is applied, and the charging voltage may not be applied for a predetermined period. Thereafter, driving of the developing roller 22 and applying of a developing bias voltage may be simultaneously performed from a time when a part of the photoconductor to which the charging voltage is not applied for driving the photoconductor reaches a development nip point in contact with the developing roller 22 before passing through the development nip, thereby forming the test pattern.

According to another example, the image forming apparatus may form the test pattern by charging the photoconductor with the charging voltage applied from the charging device and exposing a surface of the photoconductor via the exposing device 13 for a predetermined period.

FIG. 8 is a diagram for explaining an example of forming a test pattern by using a charging device and an exposure device.

Referring to FIG. 8, in a printing operation in a state in which the development nip is disengaged, a photoconductor and the intermediate transfer belt 31 are driven, and the exposure device 13 is turned on for a predetermined period in a state in which a charging voltage is applied. Thereafter, driving of the developing roller 22 and applying of a developing bias voltage may be simultaneously performed from a time when a part of the photoconductor turned on by driving of the photoconductor reaches a development nip point in contact with the developing roller 22 before passing through the development nip, thereby forming the test pattern.

According to another example, the image forming apparatus may form the test pattern by using a non-charging section of the photoconductor corresponding to a section between a point of the photoconductor facing the charging device and a point facing the developing roller 22.

FIG. 9 is a diagram for explaining an example of forming a test pattern using a non-charging section of a photoconductor. FIG. 10 is a diagram for explaining a non-charging section of a photoconductor according to an example.

Referring to FIGS. 9 and 10, in a state in which a development nip is formed, when the photoconductor, the developing roller 22, and the intermediate transfer belt 31 are driven and at the same time a charging voltage, a developing bias voltage, and the like are applied, the charging voltage is not applied to a section between a point of the photoconductor facing a charging device and a point facing the developing roller 22. Therefore, no surface potential is formed in the non-charging section of the photoconductor, and a toner moves to the photoconductor while passing through a development nip point. Thus, the test pattern may be formed. On the other hand, in the state where the development nip is disengaged, if the photoconductor, the developing roller 22, and the intermediate transfer belt 31 are driven and at the same time the charging voltage, the developing bias voltage, and the like are applied, even if the non-charging section of the photoconductor passes through the development nip point, since the developing roller 22 is spaced from the photoconductor, the test pattern may not be formed. Thus, the test pattern may be formed only when the developing roller 22 is in contact with the photoconductor.

Referring again to FIG. 6, in operation 5620, the image forming apparatus may detect a test pattern transferred to the intermediate transfer belt 31 through a sensor from a time when an operation of the adjusting member 400 moving the developing roller 22 is controlled such that the developing roller 22 moves to a developing position where the developing roller 22 is in contact with the photoconductor and the development nip is formed from a disengaging position where the developing roller 22 is spaced from the photoconductor and the development nip is disengaged.

FIG. 11 is a diagram for explaining a process of detecting a test pattern transferred to an intermediate transfer belt through a sensor according to an example.

Referring to FIG. 11, in a normal cartridge in which a development nip is normally disengaged, a time when the test pattern is formed is a time when a photoconductor is actually in contact with the developing roller 22 in a state where an off part of a charging voltage of the photoconductor (in case of FIG. 7), an exposed part thereof (in case of FIG. 8), or a non-charged part thereof (in case of FIG. 9) reaches a development nip point. Therefore, a time when the test pattern is detected by the sensor is a time when an actual contact time of the developing roller 22 and the photoconductor that are spaced from each other and a time when the test pattern reaches a point facing the sensor through a transfer nip from a development nip elapse in relation to a time for controlling an operation of the adjusting member 400 moving the developing roller 22 such that the developing roller 22 moves from a disengaging position where the developing roller 22 is spaced from the photoconductor and the development nip is disengaged to a developing position where the developing roller 22 is in contact with the photoconductor and the development nip is formed. As a time when a development nip contact command is generated is different from a time when an actual development nip contact is formed, when the developing roller 22 and the photoconductor are normally separated from each other in a development nip disengaging state, it may take some time for the adjusting member 400 adjusting the development nip to operate and for the developing roller 22 to contact the photoconductor.

On the other hand, a time when the test pattern is formed in a defective cartridge in which the developing roller 22 and the photoconductor are abnormally in contact with each other in the development nip disengaging state is a time when the off part of the charging voltage of the photoconductor (in case of FIG. 7) or the exposed part thereof (in case of FIG. 8) reaches the development nip point since the developing roller 22 is already in contact with the photoconductor. When the test pattern is formed by using the non-charged part of the photoconductor (in case of FIG. 9), a start point of a non-charging section may be a driving point since the start point is the same as the development nip point. Thus, the time when the test pattern is detected by the sensor is a time when the test pattern reaches the point where the test pattern faces the sensor through the transfer nip from the development nip elapses.

In FIG. 11, ⓐ, ⓑ, ⓒ, and ⓓ correspond respectively to the time when the test pattern reaches the point where the test pattern faces the sensor through the transfer nip from the development nip in each color cartridge.

Referring back to FIG. 6, in operation 5630, the image forming apparatus may determine whether the development nip disengaging error occurred based on the detected test pattern.

The control unit 120 of the image forming apparatus may determine whether the development nip disengaging error occurred based on the test pattern detected from the time when the operation of the adjusting member 400 to form the development nip is controlled to the time when the developing roller 22 reaches the developing position. In other words, the control unit 120 may determine whether the development nip disengaging error occurred based on the detected test pattern for a period of time from the state where the development nip is disengaged to the state where the development nip is formed.

The control unit 120 of the image forming apparatus may determine whether the development nip disengaging error occurred by using a difference between the test pattern formed in the development nip disengaging state and the test pattern formed in the development nip forming state. For example, in the case where the development nip is normally formed and disengaged, there is no test pattern for a section corresponding to a predetermined time required until the development nip is actually formed. On the contrary, when the development nip disengaging error occurred, since the development nip to be disengaged has already been formed, the test pattern exists even in a section corresponding to a normal time required until the time when the developing roller 22 reaches the developing position from the time when the operation of the adjusting member 400 for forming the development nip is controlled.

Accordingly, the control unit 120 may determine whether there is the development nip disengaging error according to a detection time of the test pattern transferred to the intermediate transfer belt 31. For example, as compared with the case where the development nip is normally formed and disengaged, the control unit 120 may determine whether the development nip disengaging error occurred when the detection time of the test pattern is earlier than a predetermined time. Also, the control unit 120 may determine whether the development nip disengaging error occurred according to a length of the test pattern transferred to the intermediate transfer belt 31 in a moving direction of the intermediate transfer belt 31. For example, as compared with the case where the development nip is normally formed and disengaged, when the length of the test pattern in the moving direction of the intermediate transfer belt 31 is longer than a predetermined length, the control unit 120 may determine that the development nip disengaging error occurred.

FIG. 12 is a diagram for explaining a method of determining whether a development nip disengaging error occurred based on a test pattern according to an example.

Referring to FIG. 12, an image forming apparatus may determine a detection time of the test pattern and a length of the test pattern for each color. In an example, the detection time of the test pattern and the length of the test pattern for each color may be determined based on a value detected for a predetermined time from a time when the test pattern is detected by a sensor in relation to a time when an operation of the adjusting member 400 moving the developing roller 22 is controlled such that the developing roller 22 moves from a disengaging position where the developing roller 22 is spaced from a photoconductor and a development nip is disengaged to a developing position where the developing roller 22 is contact with the photoconductor and the development nip is formed, i.e., a development nip contact command time.

The sensor may include a light emitting unit and a light receiving unit, and may detect a specular reflection (P wave) value or a diffuse reflection (S wave) value to detect the test pattern. The sensor may be a density sensor arranged to face the intermediate transfer belt 31 to detect a density of a toner image, and may be in the form of an image sensor. A reference value for recognizing the test pattern may be set to be ½ or less based on a bottom surface sensing value in the case of a specular reflection value using the P wave or ⅓ or more based on a bottom surface sensing value in the case of a diffuse reflection value using the S wave.

Referring to FIG. 12, it may be seen that a detection time A of the test pattern is earlier than a detection time B of the test pattern in an erroneous cartridge in which a development nip adjustment is abnormal (for each color, ① and ①', ② and ②', ③ and ③', and ④ and ④' are compared). Also, a length of the test pattern in the erroneous cartridge is longer than a length of the test pattern in a normal cartridge (⑤ and ⑤' are compared).

The image forming apparatus may notify a user of the occurrence of the development nip disengaging error. Further, the image forming apparatus may receive a response from the user with respect to notification of the development nip disengaging error and perform an operation corresponding thereto.

The above-described method of detecting the development nip disengaging error may be realized by a general-purpose digital computer which may be formed into a program that may be executed by a computer, and which operates the program using a computer-readable recording medium. Such a computer readable recording medium may be a read only memory (ROM), a random access memory (RAM), a flash memory, CD-ROMs, CD-Rs, CD+Rs, CD-ROMs, DVD-Rs, DVD+Rs, DVD-RWs, DVD+RWs, DVD-RAMs, BD-ROMs, BD-Rs, BD-R LTHs, BD-REs, magnetic tape, floppy disks, solid-stated disk (SSD), and any device capable of storing instructions or software, associated data, data files, and data structures, and providing instructions or software, associated data, and data files to a processor or a computer so as to enable the processor or the computer to execute instructions.

While various examples have been described with reference to the figures, it will be understood by those of ordinary skill in the art that various changes in form and details may be made therein without departing from the spirit and scope as defined by the following claims.

The invention claimed is:

1. An image forming apparatus capable of detecting a development nip disengaging error, the image forming apparatus comprising:

a photoconductor;

a charging device to apply a charging voltage to charge the photoconductor;

an exposing device to expose the photoconductor to light to form an electrostatic latent image thereon;

a developing roller to supply toner to the electrostatic latent image formed on the photoconductor and develop a toner image;

an adjusting member to move the developing roller to a developing position where the developing roller is in contact with the photoconductor to form a development nip and to a disengaging position where the developing roller is spaced apart from the photoconductor and the developing nip is disengaged from the photoconductor;

an intermediate transfer belt to receive the toner image formed on the photoconductor;

a sensor to detect the toner image transferred to the intermediate transfer belt; and a control unit to:

form a test pattern on the photoconductor, detect the test pattern transferred to the intermediate transfer belt through the sensor from a time when an operation of the adjusting member is controlled so as to move the developing roller from the disengaging position to the developing position, and determine whether the development nip disengaging error occurred based on the detected test pattern.

2. The image forming apparatus of claim 1, wherein the control unit determines whether the development nip disengaging error occurred based on a test pattern detected from the time when the operation of the adjusting member is controlled to a time when the developing roller reaches the developing position so as to form the development nip.

3. The image forming apparatus of claim 1, wherein the control unit determines whether the development nip disengaging error occurred according to a time when the test pattern transferred to the intermediate transfer belt is detected.

4. The image forming apparatus of claim 3, wherein the control unit determines whether the development nip disengaging error occurred when the time when the test pattern is detected is earlier than a time when the development nip is normally formed and disengaged.

5. The image forming apparatus of claim 1, wherein the control unit determines whether the development nip disengaging error occurred according to a length of the test pattern transferred to the intermediate transfer belt in a moving direction of the intermediate transfer belt.

6. The image forming apparatus of claim 5, wherein the control unit determines whether the development nip disengaging error occurred when the length of the test pattern in the moving direction of the intermediate transfer belt is longer than in cases where the development nip is normally formed and disengaged.

7. The image forming apparatus of claim 1, wherein the test pattern is formed by charging the photoconductor with the charging voltage applied from the charging device and not applying the charging voltage for a predetermined section.

8. The image forming apparatus of claim 1, wherein the test pattern is formed by charging the photoconductor with the charging voltage applied from the charging device and exposing a surface of the photoconductor with the exposing device for a predetermined section.

9. The image forming apparatus of claim 1, wherein the test pattern is formed by using a non-charging section of the photoconductor corresponding to a section between a point of the photoconductor facing the charging device and a point thereof facing the developing roller.

10. The image forming apparatus of claim 1, further comprising:

an input/output unit to:

notify a user of occurrence of the development nip disengaging error based on a determination that the development nip disengaging error occurred, and receive a response from the user.

11. The image forming apparatus of claim 1, wherein the adjusting member is located to protrude from outside of a developing cartridge, is coupled to a pressing member in a main body of the image forming apparatus, and adjusts the development nip according to a moving direction of the pressing member, and wherein a photosensitive unit comprising the photoconductor and the charging device and a developing unit comprising the developing roller are combined in the developing cartridge.

12. The image forming apparatus of claim 1, wherein the adjusting member is located in a developing cartridge in which a photosensitive unit comprising the photoconductor and the charging device and a developing unit comprising the developing roller are combined, is installed coaxially with a rotation axis of the developing roller, and adjusts the development nip according to a rotation direction of a coupler connected to a drive motor in a main body of the image forming apparatus.

13. A method of detecting a development nip disengaging error by an image forming apparatus, the method comprising:

forming a test pattern on a photoconductor;

detecting the test pattern transferred to an intermediate transfer belt through a sensor from a time when an operation of an adjusting member moving a developing roller is controlled such that the developing roller moves from a disengaging position where the developing roller is spaced from the photoconductor to disengage a development nip from the photoconductor to a developing position where the developing roller is in contact with the photoconductor to form the development nip; and determining whether the development nip disengaging error occurred based on the detected test pattern.

14. The method of claim 13, wherein the determining of whether the development nip disengaging error occurred comprises:

determining whether the development nip disengaging error occurred based on a test pattern detected from the time when the operation of the adjusting member is controlled to a time when the developing roller reaches the developing position so as to form the development nip.

15. The method of claim 13, wherein the determining of whether the development nip disengaging error occurred comprises:

determining whether the development nip disengaging error occurred according to a time when the test pattern transferred to the intermediate transfer belt is detected.

16. The method of claim 13, wherein the determining of whether the development nip disengaging error occurred comprises:

determining whether the development nip disengaging error occurred when the time when the test pattern is detected is earlier than a time when the development nip is normally formed and disengaged.

17. The method of claim 13, wherein the test pattern is formed by charging the photoconductor with a charging voltage applied from a charging device and not applying the charging voltage for a predetermined section.

18. The method of claim 13, wherein the test pattern is formed by charging the photoconductor with a charging voltage applied from a charging device and exposing a surface of the photoconductor via an exposing device for a predetermined section.

19. The method of claim 13, wherein the test pattern is formed by using a non-charging section of the photoconductor corresponding to a section between a point of the photoconductor facing a charging device and a point of the photoconductor facing the developing roller.

20. The method of claim 13, further comprising:

notifying a user of the development nip disengaging error based on a determination that the development nip disengaging error occurred.

* * * * *